US006123509A

United States Patent [19]

Hung

[11] Patent Number: 6,123,509

[45] Date of Patent: Sep. 26, 2000

[54] PRESSURE VALVE DEVICE FOR A CLEANING APPARATUS

[76] Inventor: Fred L. Hung, 2F, No. 101, Sec. 2, Chung Ching Rd., Taoyuan City Taoyuan Hsien, Taiwan

[21] Appl. No.: 09/131,401

[22] Filed: Aug. 10, 1998

[51] Int. Cl.[7] ..... F04B 49/00; E03B 17/04

[52] U.S. Cl. ..... 417/44.2; 137/881; 137/565.35

[58] Field of Search ..... 417/26, 44.2; 137/565.35, 137/560, 881, 877, 878

[56] References Cited

U.S. PATENT DOCUMENTS

| | | | |
|---|---|---|---|
| 4,134,428 | 1/1979 | Bjorklund | 137/882 |
| 5,099,871 | 3/1992 | Cowan | 137/116 |
| 5,571,259 | 11/1996 | Takasu | 239/126 |
| 5,694,966 | 12/1997 | Holder | 137/115 |
| 5,902,094 | 5/1999 | Hoenisch et al. | 417/26 |

*Primary Examiner*—Henry C. Yuen
*Assistant Examiner*—Mahmoud M Gimie
*Attorney, Agent, or Firm*—Bacon & Thomas, PLLC

[57] ABSTRACT

A pressure valve used in a cleaning apparatus. The pressure valve is provided between a pump motor and a cleaning injector. The pressure valve includes a valve body, a floating valve rod, a ball valve, a compression spring, and an adjusting screw. The valve body is connected to the water supply system via pipings (A, B, C) so that starting and shutting off of the cleaning injector can alter the water pressures in the individual chambers of the valve body, which then causes the opening and closing of the ball valve. Due to the changes in the water pressure within the chambers of the pressure valve, a floating valve rod within the pressure valve will press against a micro switch to control the starting or shutting off of the pumping motor.

8 Claims, 4 Drawing Sheets

PRESSURE VALVE DEVICE FOR A CLEANING APPARATUS

BACKGROUND OF THE INVENTION

1. Field of the Invention

The invention relates to a pressure valve structure used in a cleaning apparatus, especially to a valve structure that uses the pressure variations caused by triggering a cleaning injector to bring the pressure valve to depress a micro switch and further control the starting and shutting off of a pumping motor.

2. Description of the Prior Art

In the use of a conventional cleaning apparatus, starting and stopping a pumping motor of a conventional cleaning apparatus can be manipulated by triggering the cleaning injector but require numerous control components and the resulting complicated structure often leads to malfunction. Some improvements such as the disclosed in U. S. Pat. No. 5,571,259 have been suggested to overcome the above shortcomings.

SUMMARY OF THE INVENTION

The primary object of the invention is to provide a pressure valve structure used in a cleaning apparatus that has fewer components and can minimize the loosening of the components caused by the fluctuations in water pressure, which can lead to clogged valve ports and damage to the pump motor. The valve structure according to the invention can simplify the assemblage of the valve and reduce manufacturing costs.

The secondary object of the invention is to provide a pressure valve structure used in a cleaning apparatus that uses the pressure variations of water flows to alter the on or off states of a micro switch, which controls the running of a pumping motor.

DETAILED DESCRIPTION OF THE PREFERRED EMBODIMENTS

Figure 1:
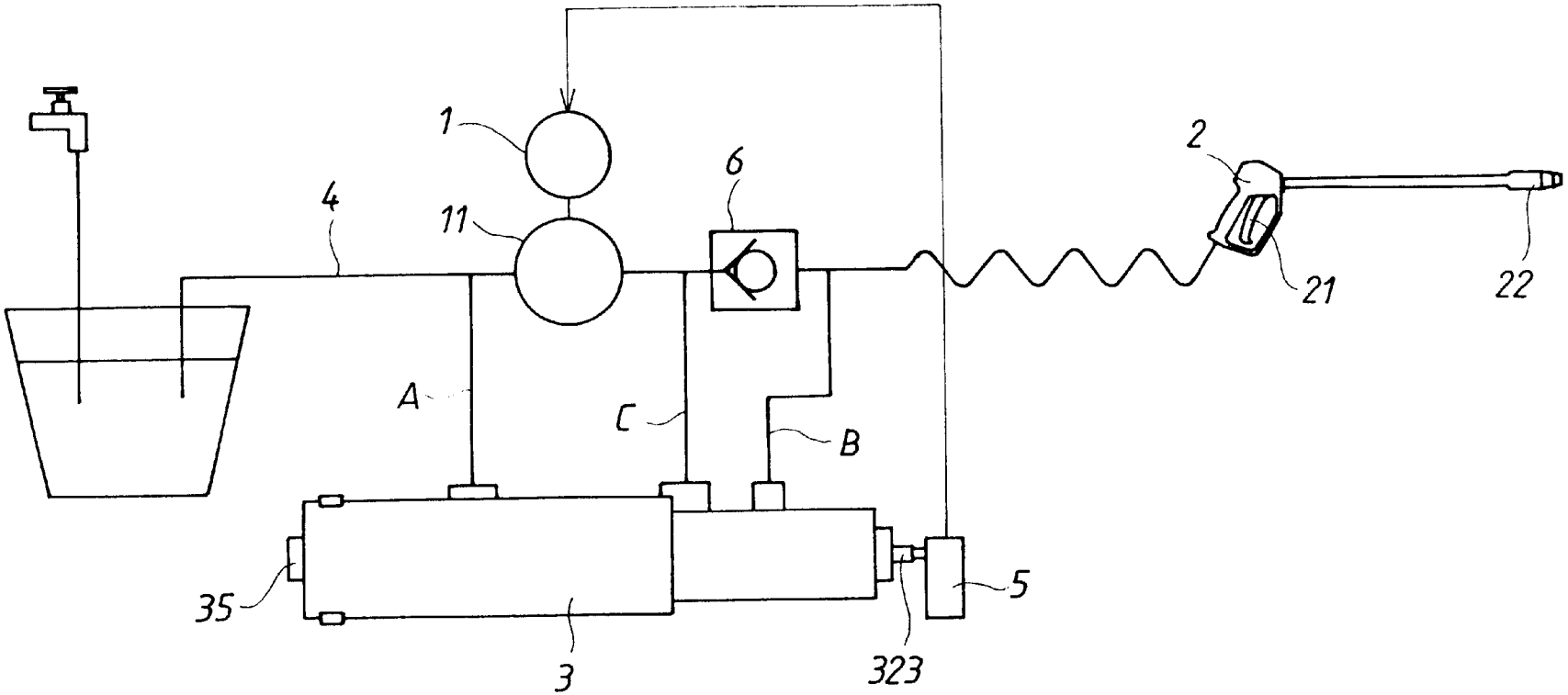
FIG. 1 is a schematic drawing of an embodiment of the cleaning apparatus according to the invention.

FIG. 1 is a schematic view illustrating that a water supply system 4 integrates a pump motor 1, a cleaning injector 2, and a pressure valve 3 into an embodiment of the cleaning apparatus according to the invention. The pressure valve 3 is disposed between the pump motor 1 and the cleaning injector 2, and is provided at one end thereof with a micro switch 5 electrically connected to the pump motor 1. The pump motor 1 is further connected at the output end to a booster pump 11. With this arrangement, when the cleaning apparatus is actuated, the water flows from the water supply system 4 and pressurized by the pump motor 1 and water will exit from the cleaning injector 2 via a check valve 6. The handle of the cleaning injector 2 is equipped with a trigger 21 that controls the opening and closing of the nozzle 22 to allow or stop water flow. The pump motor 1, cleaning injector 2, the water supply system 4, the micro switch 5, and the check valve are already known in this field. We will not discuss them here in detail. However, the features of the cleaning apparatus according to the invention are as follows.

Figure 2:
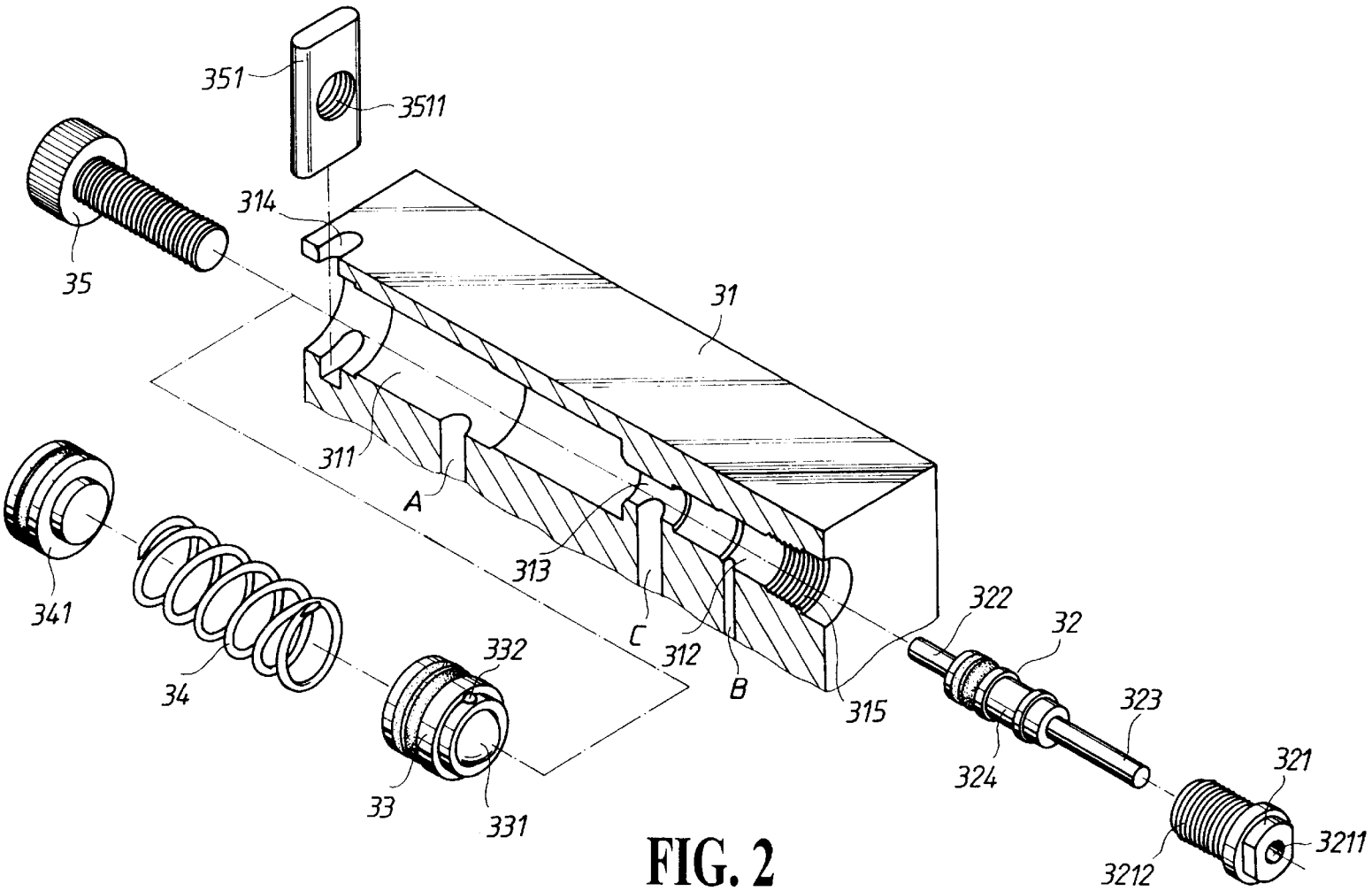
FIG. 2 is an exploded view of an embodiment of the pressure valve according to the invention.

The pressure valve 3, as shown in FIG. 2, comprises a valve body 31 that can be constructed by drilling a hole on the upper portion of the booster pump 11 and houses a floating valve rod 32, a ball valve 33, a compression spring 34, and an adjusting screw 35.

The valve body 31 has a large valve chamber 311 at one end, a small pumping section 312 at the other end, and an in-between transition section 313 having the smallest volume compared to the foregoing two portions. The valve chamber 311 communicates with the water supply system 4 ahead of the booster pump 11 via through the returning water piping A and abuts against a radial deep notch 314 on the outer side of the valve chamber 311 facing the adjusting screw 35. The pumping section 312 has a tapped segment 315 formed near the outer end housing the floating valve rod 32 and connects to the water supply system 4 between the check valve 6 and the cleaning injector 2 through the piping B. The transition section 313 connects to the water supply system 4 between the booster pump 11 and the check valve 6 by way of the piping C.

The floating valve rod 32 is located inside the pumping section 312 with the aid of a valve plunger head 321. The valve plunger head 321 has a through bore 3211 at the center, an external threaded section 3212 on the exterior surface. The floating valve rod 32 is provided with a push rod 322 at one end, a valve stem 323 at the other end, and an intermediate segment 324 that has a reduced diameter mating with the inner diameter of the pumping section 312 and corresponding to the port size of the piping B.

The ball valve 33 is installed inside the valve chamber 311, with one end thereof engaged with a ball plunger 331 between the valve chamber 311 and the transition section 313 to govern the opening the closing of the passageway and an adjusting bore 332 obliquely extending through two ends of the valve body.

The compression spring 34 in conjunction with a spring base 341 is seated inside the valve chamber 311 to press against the ball valve 33.

The adjusting screw 35 is driven into a tapped bore 3511 formed on a retaining plate 351 in a deep notch 314 to press against the bottom of the spring base 341 to adjust the biasing force of the spring 34 exerted on the ball valve 33.

Figure 3:
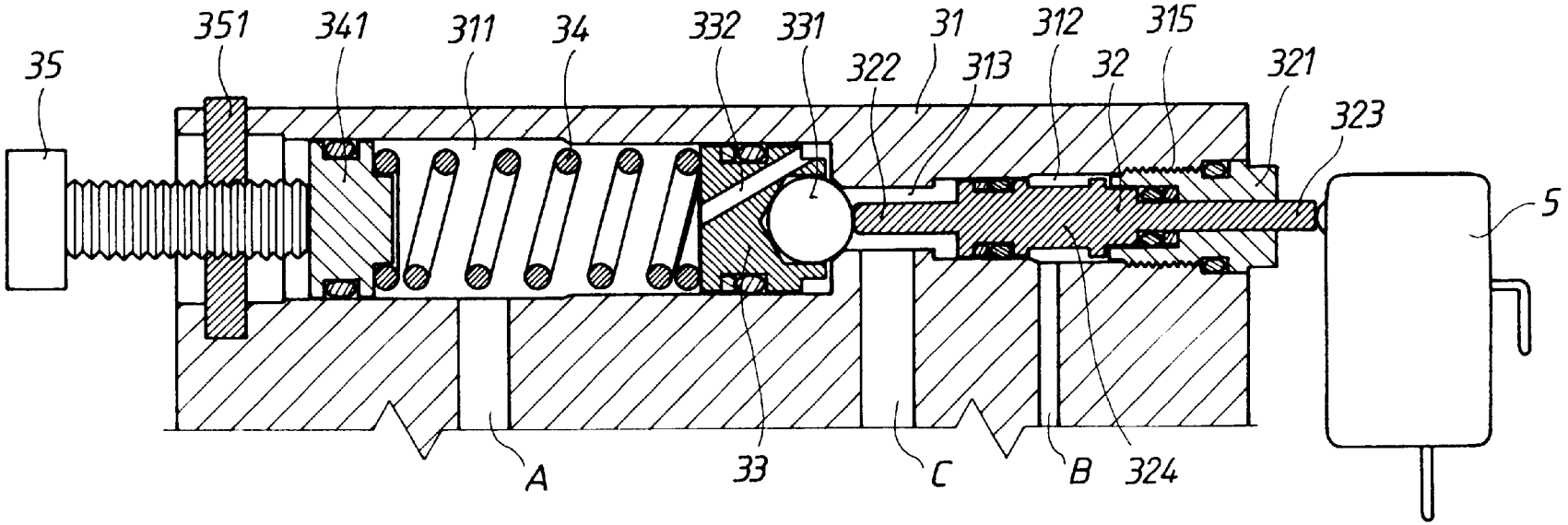
FIG. 3 is a cross sectional view of the pressure valve shown in FIG. 2.

These components are assembled as shown in FIG. 3. The ball valve 33, the compression spring 34, and the spring base 341 are firstly placed into the valve chamber 311 at one end of the valve body 31 in sequence. Next, the retaining plate 351 is inserted into the deep notch 314 with the adjustment screw 35 passing through the tapped hole 3511 of the retaining plate 351 and exerting a force against the bottom of the valve base 341. Then the floating valve rod 32 is extended into the pumping section 312 of the valve body 31 and secured by engaging the external thread section 3212 of the valve plunger 321 with the internal threads of the pumping section 312. The floating valve rod 32 sustains the ball plunger 331 of the ball valve 33 by a push rod 322 at one end and extends a valve stem 323 at the other end to pass through a through hole 3211 of the valve plunger head 321 to the outside and rest on a micro switch 5 of the pressure valve 3.

Figure 4:
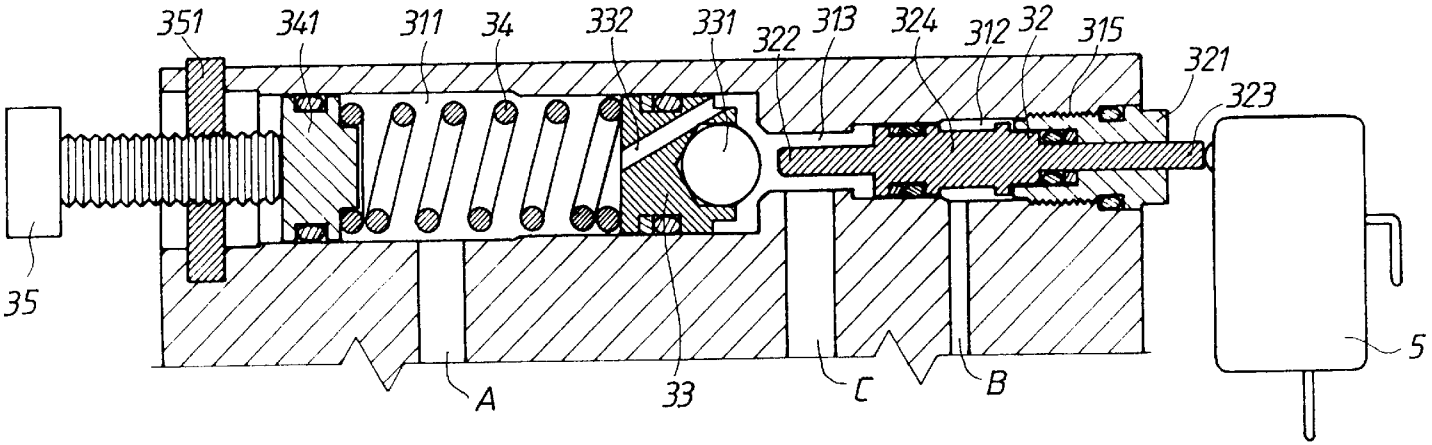
FIG. 4 is an operational view of FIG. 3 illustrating the micro switch of the invention in an on state.
Figure 5:
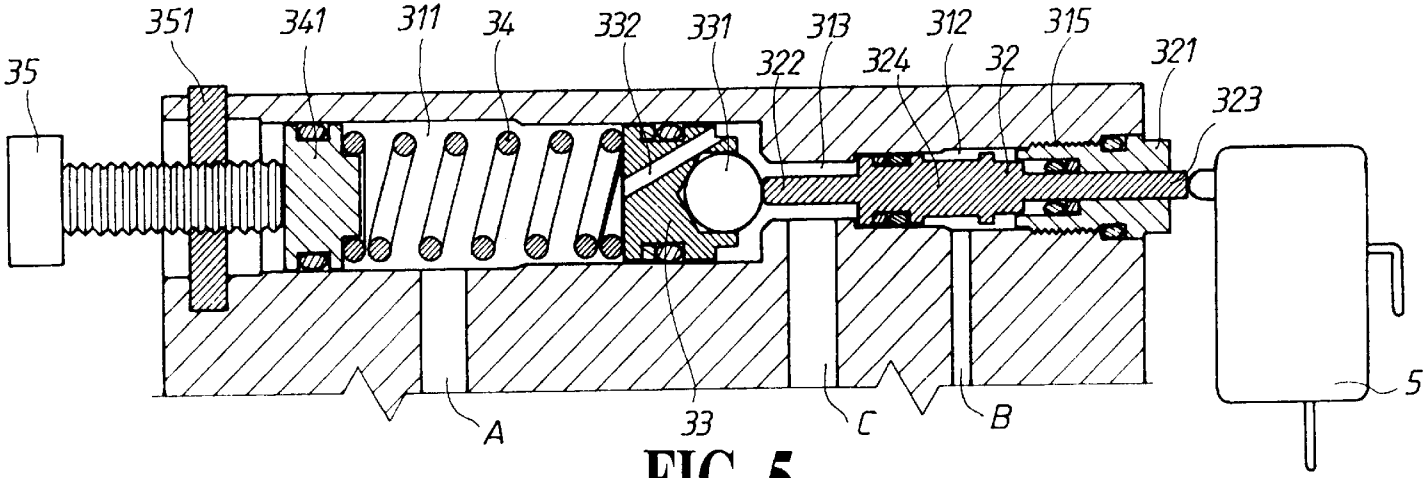
FIG. 5 is an operational view of FIG. 3 illustrating the micro switch of the invention in an off state.

When a cleaning apparatus is in operation and then stops to inject water from the nozzle 2, the water supply system 4 continues to supply water into the piping B and C because the motor is still running. Accordingly the pressure in the piping B and C rises. As a result the pressure in the transition section 313 rises, which in turn increases the forces exerted on the ball valve 33. As the pressure in the transition section 313 exceeds the forces exerted on the ball valve 33 by the compression spring 34, the ball valve retracts from the communicating gate between the valve chamber 311 and the transition section 313 as shown in FIG. 4. At that moment, the valve stem 323 of the floating valve rod 32 still presses against the micro switch 5 to keep it in an on state, which keeps the pump motor 1 running. Water from the water supply system 4 continues flowing into the piping C by the output of the pump motor 1. A part of the water flow enters the piping A via the adjustment bore 332 of the ball valve 33 so that the water pressure in the piping C drops. As a result, the pressure on two sides of the ball valve 33 comes to a balance and the ball valve 33 stays in a state of being kept away from the communicating gate. The water pressure of the piping C further drops to a value smaller than the pressure of the piping B. The water flow in the piping B exerts an action force on the intermediate segment 324 of the floating valve rod 32 to urge the floating valve rod 32 to move from the pumping section 312 to the transition section 313. Accordingly the push rod 322 presses against the ball plunger 331 of the ball valve 33 and the valve stem 323 of the floating valve rod 32 releases the closed micro switch 5 to an open state as shown in FIG. 5. Thus the pumping motor 1 comes to a halt.

Furthermore, after the pumping motor 1 stops, the pressure in the piping C disappears but the water pressure in the piping B still exists. As a consequence, the floating valve rod 32 is kept to press against the ball plunger 331 of the ball valve 33 because the spring force born on the ball valve 33 is smaller than the depressing force exerted on the floating valve rod 32. The micro switch 5 is still in an off state.

When the trigger 21 of the cleaning injector 2 is depressed to an open state again, the pressure in the piping B is released and the force exerted on the ball valve 33 by the compression spring 34 becomes larger than the supporting force coming from the floating valve rod 32. The floating valve rod 32 goes back to the initial position and the valve stem 323 of the valve rod 32 acts upon the micro switch 5 with a force, which leads the micro switch 5 to an on state again. With the aids of the electrical circuit of the apparatus, the pumping motor 1 starts to run and then the water flow comes out from the nozzle 22 of the cleaning injector 2.

What is claimed is:

1. A pressure valve device for a cleaning apparatus comprising:

a water supply system;

a pump motor;

a micro switch electrically connected to the pump motor;

a booster pump powered by the pump motor, the booster pump in communication with the water supply system;

a cleaning injector in communication with the water supply system;

a check valve arranged between the booster pump and the cleaning injector along the water supply system;

a pressure valve in communication with the water supply system via pipings (A, B,C), the pressure valve including a valve chamber at a first end, a pumping section at a second end, a transition section arranged between and in communication with the valve chamber and the small pumping section, the transition section displacing a smaller volume than displacement volumes of either the valve chamber or the small pumping section;

a floating valve rod housed in the pumping section and having a push rod that extends into the transition section, a valve stem that extends out of the pumping section, an intermediate segment having a reduced diameter;

the piping (A) connected to the water supply system ahead of the booster pump and in communication with the valve chamber, the piping (C) connected to the water supply system between the booster pump and the check valve and in communication with the transition section and the push rod of the floating valve rod, the piping (B) connected to the water supply system between the check valve and the cleaning injector and in communication with the pumping section and the intermediate segment of the floating valve rod;

a valve plunger head having a through bore arranged to slidably receive the valve stem of the floating valve rod, the valve plunger head secured at the second end of the pressure valve;

a ball valve positioned in the valve chamber and having an adjusting bore extending there through to avoid direct communication with the transition section when the ball valve abuts against the transition section;

a compression spring positioned between and contacting a spring base and the ball valve within the valve chamber; and a retaining plate configured to close the first end of the pressure valve.

2. The pressure valve device for a cleaning apparatus as recited in claim 1, wherein the pressure can be housed in the booster pump.

3. The pressure valve device for a cleaning apparatus as recited in claim 1, wherein the valve chamber includes a radial deep notch configured to house the retaining plate.

4. The pressure valve device for a cleaning apparatus as recited in claim 1, wherein the valve plunger head is threadably secured to the pumping section.

5. The pressure valve device for a cleaning apparatus as recited in claim 1, wherein the intermediate segment of the floating valve rod is in communication with piping (C).

6. The pressure valve device for a cleaning apparatus as recited in claim 1, wherein a communication port is arranged between the valve chamber and the transition section and the ball plunger configured to close the communicating port due to pressure differences in pipings (A, B, C).

7. The pressure valve device for a cleaning apparatus as recited in claim 1, wherein the retaining plate includes an adjusting device that adjustably exerts a force on the spring.

8. The pressure valve device for a cleaning apparatus as recited in claim 7, wherein the adjusting device is an adjusting screw threadably attached through, the retaining plate to adjustably push against the spring base.

* * * * *